US009422794B2

(12) United States Patent
Di Crescenzo et al.

(10) Patent No.: US 9,422,794 B2
(45) **Date of Patent: *Aug. 23, 2016**

(54) SYSTEM FOR LINING A WELLBORE

(75) Inventors: Daniele Di Crescenzo, Rijswijk (NL); Antonius Leonardus Maria Wubben, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 361 days.

This patent is subject to a terminal disclaimer.

(21) Appl. No.: 13/982,703

(22) PCT Filed: Jan. 30, 2012

(86) PCT No.: PCT/EP2012/051461

§ 371 (c)(1),
(2), (4) Date: Jul. 30, 2013

(87) PCT Pub. No.: WO2012/104257

PCT Pub. Date: Aug. 9, 2012

(65) Prior Publication Data

US 2013/0312954 A1 Nov. 28, 2013

(30) Foreign Application Priority Data

Feb. 2, 2011 (EP) ..... 11152987

(51) Int. Cl.
*E21B 43/10* (2006.01)
*E21B 33/129* (2006.01)

(52) U.S. Cl.
CPC ..... *E21B 43/103* (2013.01); *E21B 33/1292* (2013.01)

(58) Field of Classification Search
CPC ... E21B 43/105; E21B 43/103; E21B 43/106; E21B 43/108
See application file for complete search history.

(56) References Cited

U.S. PATENT DOCUMENTS

| | | | | |
|---|---|---|---|---|
| 3,162,245 | A | 12/1964 | Howard et al. | 166/63 |
| 3,179,168 | A * | 4/1965 | Vincent | 166/277 |
| 3,374,839 | A * | 3/1968 | Lebourg | 166/131 |
| 6,142,230 | A * | 11/2000 | Smalley et al. | 166/277 |
| 6,854,521 | B2 * | 2/2005 | Echols et al. | 166/387 |

(Continued)

FOREIGN PATENT DOCUMENTS

| | | | |
|---|---|---|---|
| EP | 2119867 | 11/2009 | E21B 29/00 |
| GB | 2386626 | 9/2003 | E21B 29/00 |

OTHER PUBLICATIONS

PCT International Search Report, Application No. PCT/EP2012/051461 dated Mar. 6, 2012.

*Primary Examiner* — Blake Michener
*Assistant Examiner* — Kipp Wallace

(57) ABSTRACT

The invention provides a system for lining a wellbore. The system comprises an expandable tubular element arranged in the wellbore, the tubular element having a first end part and a second end part whereby the second end part extends into a tubular wall located in the wellbore. An expander is arranged to radially expand the tubular element by movement of the expander through the tubular element in a direction from the first end part to the second end part, said direction defining an expansion direction. The system further comprises an anchor arranged to anchor said second end part to the tubular wall in a manner that the anchor substantially prevents movement of said second end part in the expansion direction and allows movement of said second end part in the direction opposite to the expansion direction.

6 Claims, 6 Drawing Sheets

(56) References Cited

U.S. PATENT DOCUMENTS

Figure 1:
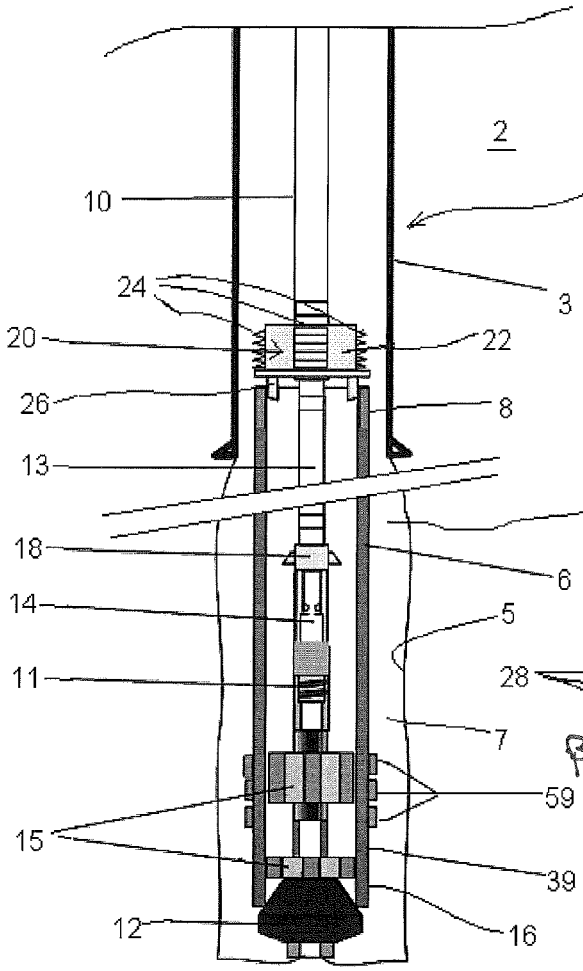

| | | | | |
|---|---|---|---|---|
| 7,708,063 | B2 * | 5/2010 | Palmer | E21B 17/10 166/241.1 |
| 8,051,913 | B2 * | 11/2011 | Huang | E21B 33/1212 166/187 |
| 9,004,184 | B2 * | 4/2015 | Di Crescenzo et al. | 166/382 |
| 2003/0205386 | A1 | 11/2003 | Johnston et al. | 166/382 |
| 2003/0217844 | A1 * | 11/2003 | Moyes | 166/118 |
| 2004/0231860 | A1 | 11/2004 | Whanger et al. | 166/382 |
| 2007/0068671 | A1 * | 3/2007 | Lohbeck | 166/207 |
| 2008/0156499 | A1 * | 7/2008 | Giroux et al. | 166/380 |
| 2009/0065196 | A1 | 3/2009 | Holland et al. | 166/207 |
| 2009/0205840 | A1 * | 8/2009 | O'Connor et al. | 166/382 |
| 2009/0266560 | A1 * | 10/2009 | Ring et al. | 166/384 |
| 2010/0090410 | A1 * | 4/2010 | Doane | E21B 33/1212 277/323 |
| 2010/0270035 | A1 * | 10/2010 | Ring et al. | 166/384 |

* cited by examiner

SYSTEM FOR LINING A WELLBORE

PRIORITY CLAIM

The present application which is a 371 application of PCT/EP2012/051461, filed Jan. 30, 2012, claims priority from European application 11152987.1, filed Feb. 2, 2011.

The present invention relates to a system for lining a wellbore, the system comprising an expandable tubular element arranged in the wellbore. The wellbore is, for example, a wellbore for the production of hydrocarbon fluid.

During conventional wellbore drilling, sections of the wellbore are drilled and provided with a casing or a liner in subsequent steps. In each step, a drill string is lowered through the casings already installed in the wellbore, and a new wellbore section is drilled below the installed casings or liners. In view of this procedure, each casing that is to be installed in a newly drilled wellbore section must pass through a previously installed casing. Therefore the new casing has a smaller outer diameter than the inner diameter of the previous casing. As a consequence, the diameter of the wellbore available for the production of hydrocarbon fluid decreases with depth. For relatively deep wells this consequence can lead to impractically small diameters.

In conventional wellbore terminology the word "casing" refers to a tubular member extending from surface into the wellbore, and the word "liner" refers to a tubular member extending from a downhole location into the wellbore. However in the context of this description, references to "casing" and "liner" are made without such implied difference.

It has been proposed to overcome the problem of stepwise smaller inner diameters of wellbore casing by using a system whereby an expandable tubular element is lowered into the wellbore and thereafter radially expanded to a larger diameter using an expander which is pulled, pushed or pumped through the tubular element.

US-2004/0231860-A1 discloses such system whereby an end portion of an expandable tubular element is first expanded against the wellbore wall so as to anchor the end portion to the wellbore wall. An inflatable packer suspended on a deployment string is used to expand the end portion. Thereafter the deployment string is retrieved to surface, and a working string provided with an expander is lowered into the wellbore to expand the remainder of the tubular element.

It is a drawback of the known system that separate strings need to be run into the wellbore to anchor the end portion of the tubular element to the wellbore wall and thereafter to expand the remainder of the tubular element with the expander. Moreover during expansion with the expander, the expansion forces are relatively high since the expander moves away from the anchored end portion so that the tubular element is expanded under axial tensile forces.

U.S. Pat. No. 3,162,245 discloses a method and an apparatus for setting a metallic liner inside a casing in a well. The apparatus is used on a wireline. Upon igniting a propellant, the gases from the propellant press hydraulically-actuated slips against the casing wall. At the same time, the gas pressure is applied to a hydraulic cylinder and piston where it acts to force an expander cone through a corrugated tube expanding the tube out against the casing. When the cone reaches a rod, pressure on the rod actuates a firing mechanism which detonates a booster charge to destroy a fangible cylinder as well as said rod.

Disadvantages of the apparatus of U.S. Pat. No. 3,162,245 include the once-only use thereof, due to the destruction of the cylinder and rod. Debris will remain in the wellbore, possibly causing obstruction. Additionally, the apparatus is designed for use on a wire line, and all forces for expanding the corrugated tube are dealt with in a closed-loop system within the piston-cylinder assembly of the apparatus. The slips are not included in said loop and are unsuitable to exert expansion forces in axial direction to the casing.

It is an object of the invention to provide an improved system for lining a wellbore, which overcomes the drawback of the prior art.

In accordance with the invention there is provided a system for lining a wellbore, the system comprising an expandable tubular element arranged in the wellbore, the tubular element having a first end part and a second end part whereby the second end part extends into a tubular wall located in the wellbore, an expander arranged to radially expand the tubular element by movement of the expander through the tubular element in a direction from the first end part to the second end part, said direction defining an expansion direction, the system further comprising an anchor arranged to anchor said second end part to the tubular wall in a manner that the anchor substantially prevents movement of said second end part in the expansion direction and allows movement of said second end part in the direction opposite to the expansion direction.

The anchor provides the necessary reaction force to counter the expansion forces exerted to the tubular element by the expander, therefore there is no need for a separate string to first expand an end portion of the tubular element against the wellbore wall to provide the necessary reaction force. At the same time, the anchor compensates for axial shortening of the tubular element during the expansion process by allowing the second end part to move in the direction opposite to the expansion direction. Furthermore, the expansion forces are relatively low since the tubular element is expanded under axial compression by virtue of the expander being moved towards the anchor.

Suitably the anchor is provided with an anchor body and at least one anchor member arranged to grip said tubular wall upon a selected movement of the anchor body in the expansion direction, and wherein the anchor member is arranged to release said tubular wall upon a selected movement of the anchor body in the direction opposite to the expansion direction. For example, the anchor can be provided with a plurality of said anchor members mutually spaced in circumferential direction of the anchor.

To allow easy lowering of the anchor into the wellbore, it is preferred that each anchor member is movable between a radially extended position in which the anchor member is extended against said tubular wall and a radially retracted position in which the anchor member is retracted from said tubular wall.

Each anchor member is preferably controlled from surface by an elongate string extending from surface to the anchor, wherein the elongate string is arranged to cooperate with the anchor so as to move each anchor member between the extended position and the retracted position thereof.

Suitably each anchor member is movable to the extended position by an activating parameter selected from hydraulic pressure in the elongate string, a sequence of rotations and/or translations of the elongate string, and a combination of hydraulic pressure in the elongate string and a sequence of rotations and/or translations of the elongate string. The elongate string can be, for example, a drill string.

In an exemplary embodiment the drill string (or other elongate string) passes through a central passage of the anchor body, whereby the drill string is provided with a mandrel arranged in the central passage. The mandrel is temporarily connected to the anchor body by one or more shear pins which are arranged to break by the action of hydraulic pressure in the bore of the elongate string. Thus, upon failure of the shear pins, the anchor body becomes disconnected from the drill string. At the same time, the hydraulic pressure induces each anchor member to be moved to its radially extended position.

In an alternative embodiment the mandrel is provided with at least one pin, whereby each pin can move through a corresponding J-lock shaped groove provided at the inner surface of the anchor body, comparable to the mechanism in a ball point. During running-in of the assembly into the wellbore, the pins carry the anchor by means of the J-lock shaped grooves. Once the assembly is at target depth, a sequence of drill string rotation(s) and translation(s) enables each pin to pass through the corresponding groove and release the anchor body from the mandrel. To activate the anchor members, the top of the anchor body is provided with friction blocks which drag along the surrounding tubular wall when the anchor moves relative to the surrounding wall. Thus, when the anchor is moved upwards by the tubular element which is to be expanded, the drag force between the friction blocks and the surrounding wall causes each anchor member to be pushed radially outward into engagement with the surrounding wall.

In a preferred embodiment the elongate string is provided with a release sub and the anchor is provided with a release device, the release sub and the release device being arranged to cooperate with each other so as to induce the anchor member to move to the retracted position upon pulling of the release sub against the release device.

To ensure that the expander is properly positioned before being pulled into the tubular element, the system preferably includes a centraliser for centralising the expander relative to the tubular element, the centraliser extending into said first end part of the tubular element and being releasably connected thereto. Suitably the centraliser is adapted to be released from the first end part of the tubular element upon pulling of the expander through the tubular element in the expansion direction.

In practice there will be an annular space between the tubular element and the wall of the wellbore, which can be filled with cement to seal against the rock formation and to affix the tubular element in the wellbore after expansion. In order to prevent flow-back of fluidic cement into the tubular element during expansion of the tubular element, it is preferred that the tubular element is provided with sealing means for sealing the annular space, the sealing means including a foldable wall section of the tubular element, the foldable wall section having a reduced bending stiffness relative to a remainder wall section of the tubular element and being deformable from an unfolded mode to a folded mode by application of a compressive folding force to the tubular element, wherein the foldable wall section when in the folded mode comprises at least one annular fold extending radially outward into said annular space. By virtue of the foldable wall section, the tubular element can be lowered into the wellbore with the foldable wall section in the unfolded mode. Thereafter the foldable wall section can be deformed to the folded mode. Thus, the sealing means does not form an obstruction during the lowering process and therefore there is a reduced risk of the tubular element becoming stuck during the lowering process.

In a preferred embodiment said wall section of reduced bending stiffness comprises a wall section of reduced thickness relative to said remainder wall section. For example, the wall section of reduced thickness in the folded mode thereof comprises a plurality of folds in a concertina shape.

In order to initiate folding of the section of reduced wall thickness at a predetermined location and/or to reduce the magnitude of the folding force during an initial stage of the folding process, it is preferred that the section of reduced wall thickness is provided with a relatively small annular groove extending in circumferential direction along at least one of the inner surface and the outer surface of the section of reduced wall thickness.

Also, the wall section of reduced bending stiffness can comprise a plurality of annular grooves formed in the tubular element, wherein each fold has an upper leg extending between a first annular groove and a second annular groove, and a lower leg extending between the second annular groove and a third annular groove.

An expansion force needs to be applied to the expander in order to move the expander through the tubular element during radial expansion of the tubular element. It is preferred that the reduced bending stiffness of the foldable wall section is selected such that the magnitude of said folding force is lower than the magnitude of the expansion force. It is thereby achieved that the foldable wall section is deformed into the folded mode by the compressive force exerted by the expander before the expander starts expanding the tubular element. This is advantageous because each fold thus formed is further expanded as the expander passes through the fold. As a result, the folded wall section has a relatively large expansion ratio.

In an attractive embodiment of the system of the invention, said first end part is a lower end part of the tubular element, and said second end part is an upper end part of the tubular element.

The anchor is suitably referred to as "top anchor". To ensure that the first end part of the tubular element remains at a selected depth during the expansion process, and thereby provides a reference point for a next tubular element to be installed in the wellbore, it is preferred that the first end part is provided with a bottom anchor adapted to anchor the first end part to the wall of the wellbore as a result of radial expansion of said first end part by the expander. With the first end part anchored to the wellbore wall by the bottom anchor, axial shortening of the tubular element due to the expansion process is accommodated by the top anchor which allows movement of the second end part of the tubular element in the direction opposite to the expansion direction.

Figure 2:
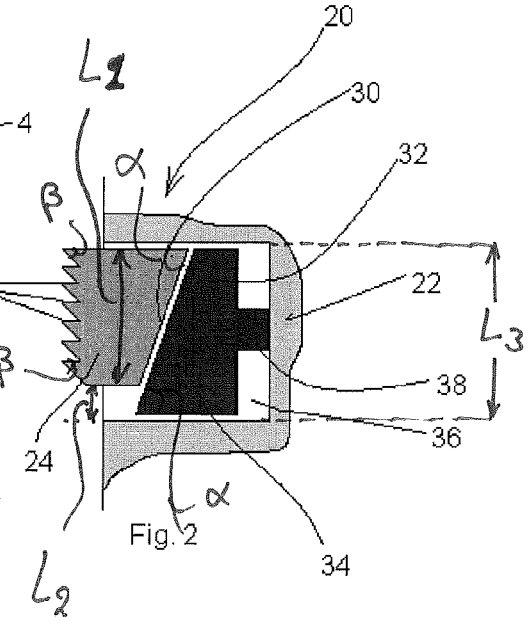
Figure 3:
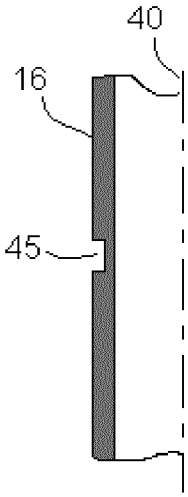
Figure 4:
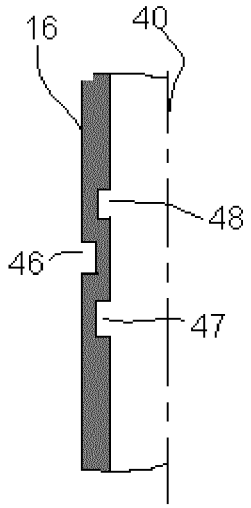
Figure 5:
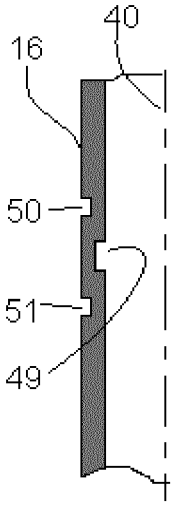
Figure 6:
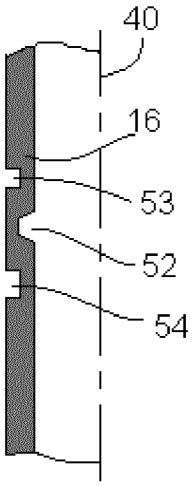
Figure 7:
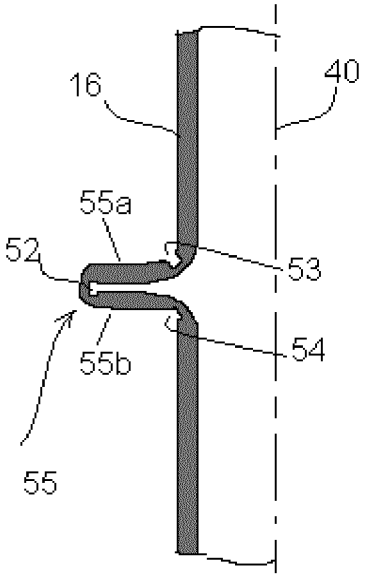
Figure 8:
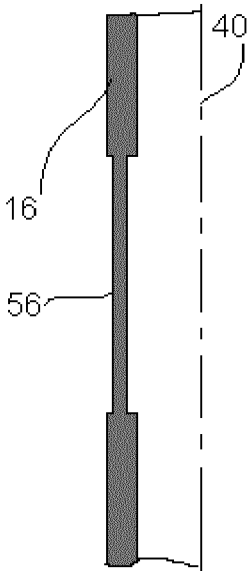
Figure 9:
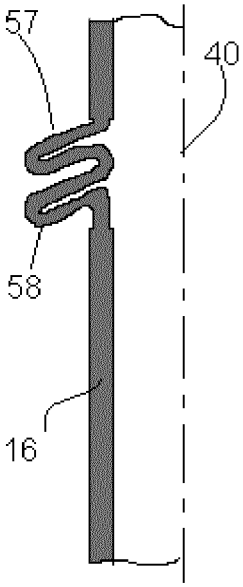
Figure 10:
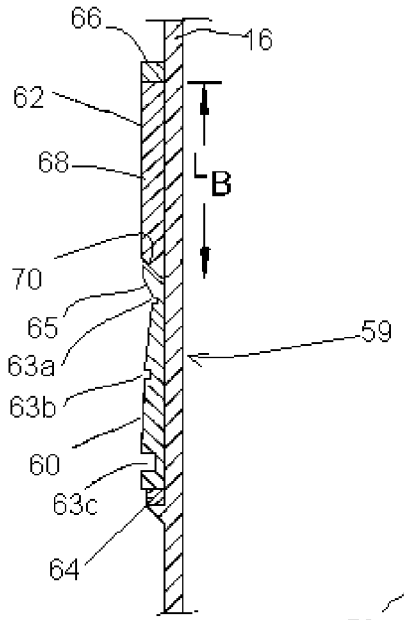
Figure 11:
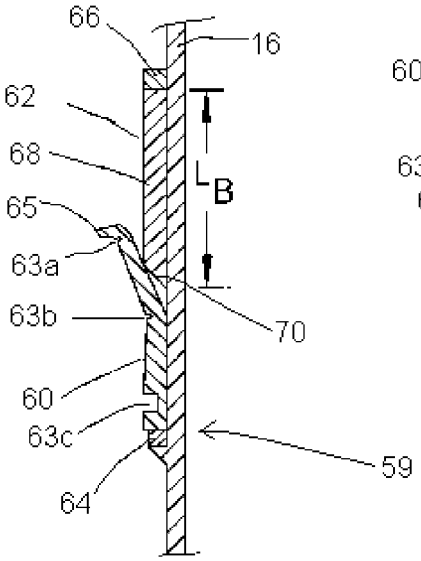
Figure 12:
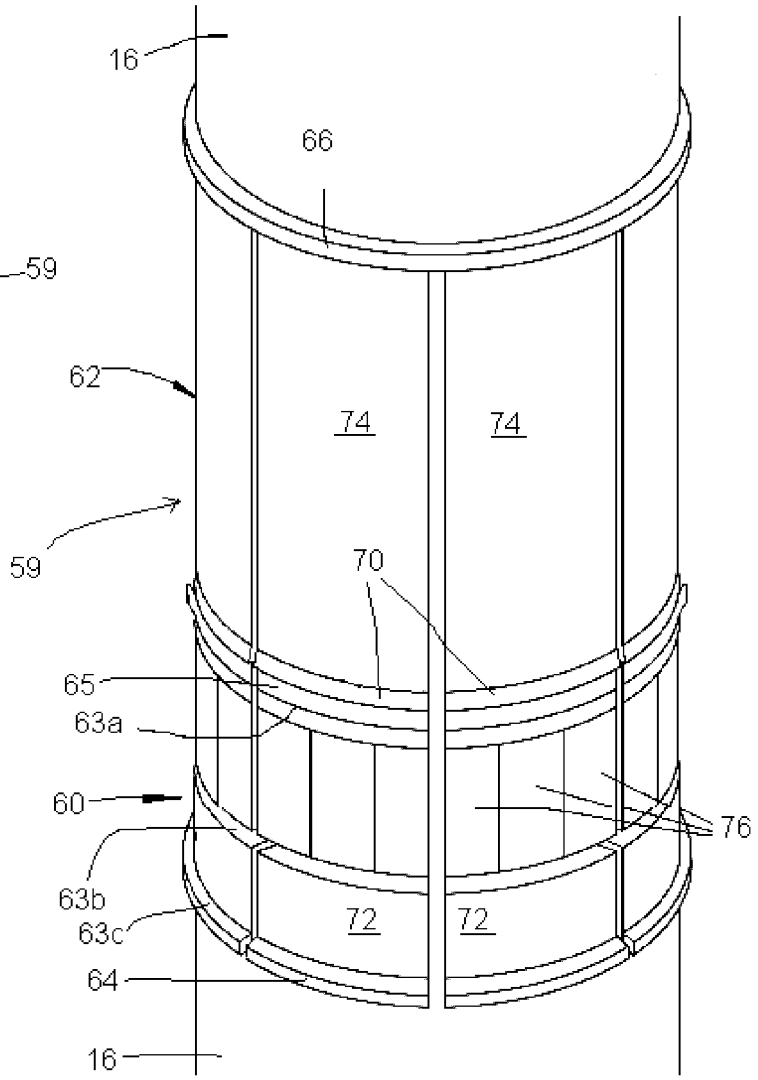
Figure 13:
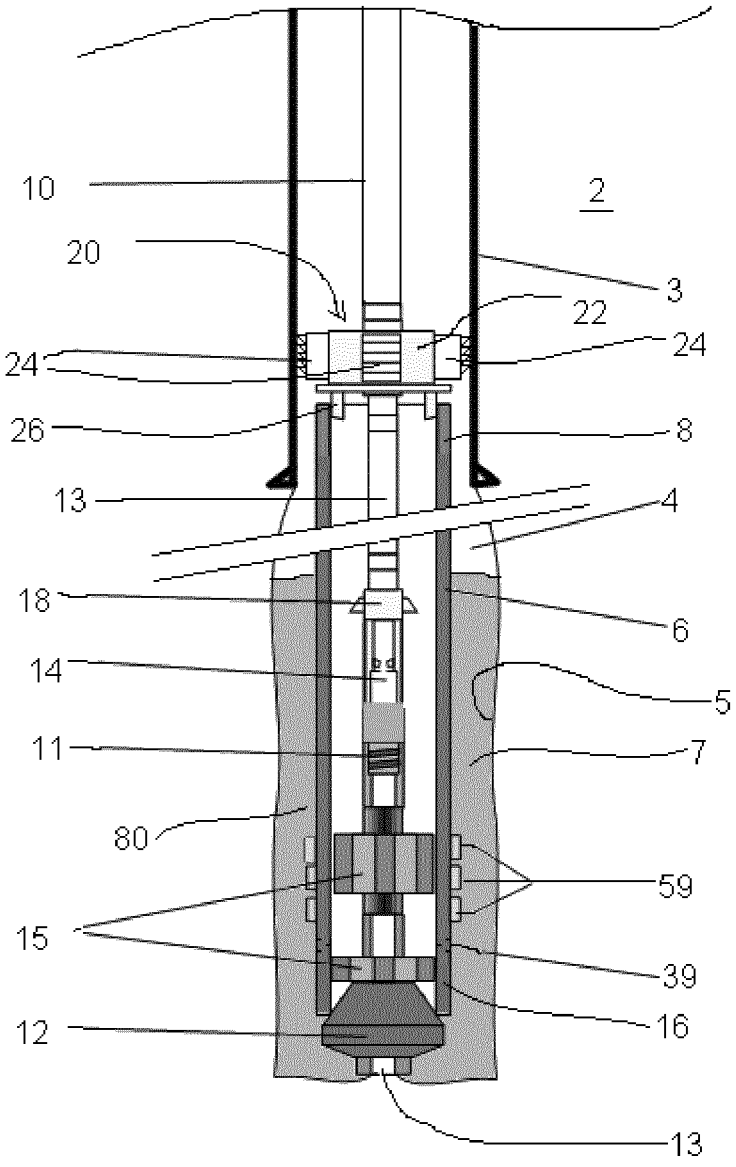
Figure 14:
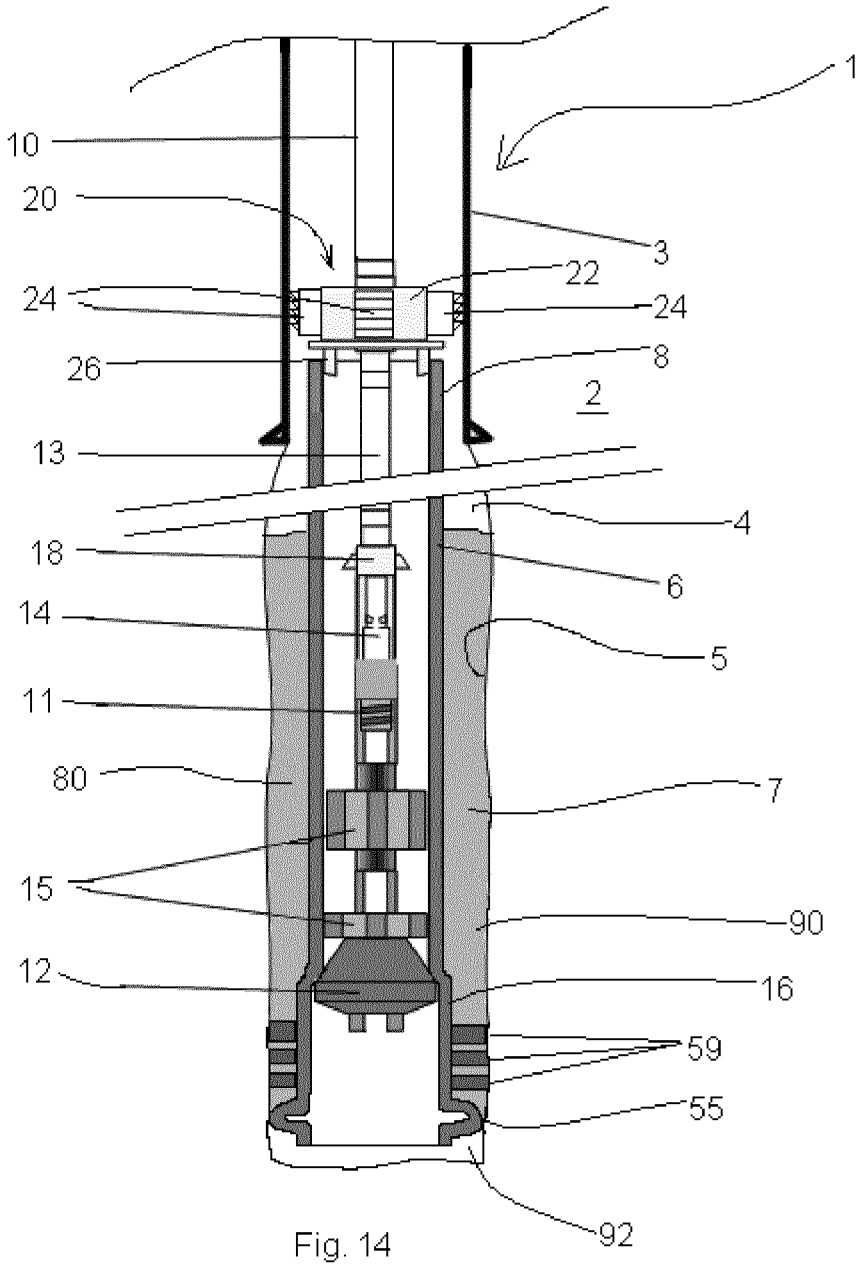
Figure 15:
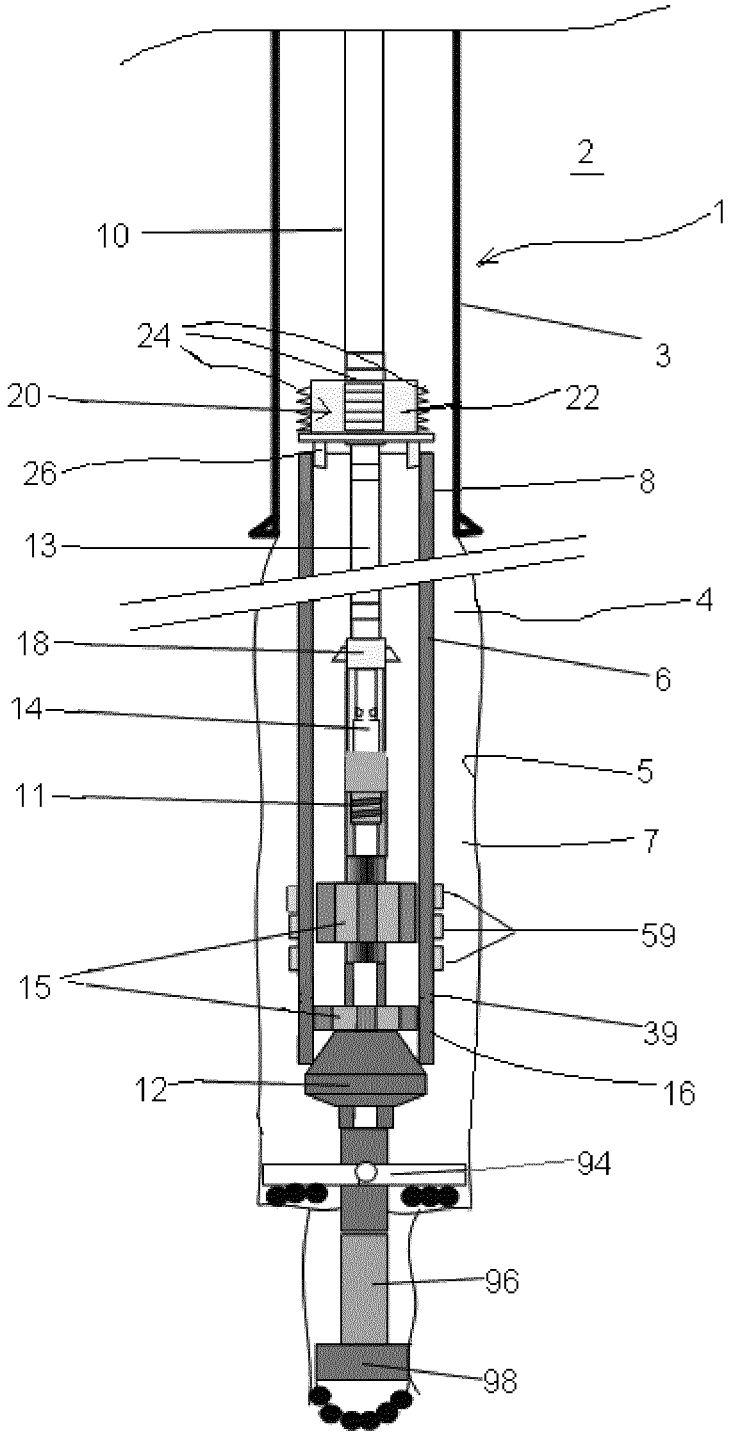

The invention will be described hereinafter in more detail and by way of example with reference to the accompanying drawings in which:

FIG. 1 schematically shows, in longitudinal section, an embodiment of the system for lining a wellbore according to the invention, whereby an expandable tubular element extends in the wellbore;

FIG. 2 schematically shows a detail of a top anchor of the embodiment of FIG. 1;

FIG. 3 schematically shows a first embodiment of a lower wall portion of the tubular element;

FIG. 4 schematically shows a second embodiment of a lower wall portion of the tubular element;

FIG. 5 schematically shows a third embodiment of a lower wall portion of the tubular element;

FIG. 6 schematically shows a fourth embodiment of a lower wall portion of the tubular element;

FIG. 7 schematically shows the fourth embodiment after folding of the lower wall portion;

FIG. 8 schematically shows a fifth embodiment of a lower wall portion of the tubular element;

FIG. 9 schematically shows the fifth embodiment after folding of the lower wall portion;

FIG. 10 schematically shows a detail of a bottom anchor of the embodiment of FIG. 1;

FIG. 11 schematically shows the bottom anchor during radial expansion of the tubular element;

FIG. 12 schematically shows a perspective view of the bottom anchor;

FIG. 13 schematically shows the embodiment of FIG. 1 after cement has been pumped into the wellbore and the top anchor has been extended against a casing in the wellbore;

FIG. 14 schematically shows the embodiment of FIG. 1 during radial expansion of the tubular element; and FIG. 15 shows an alternative embodiment of the system of the invention.

In the detailed description hereinafter, like reference numerals relate to like components.

Referring to FIG. 1 there is shown a wellbore 1 extending into an earth formation 2. The wellbore 1 is provided with a casing 3 or similar tubular element which has been cemented in the wellbore 1. An open hole section 4 of the wellbore 1 extends below the casing 3. Reference numeral 5 indicates the wall of open wellbore section 4. An expandable tubular element in the form of expandable liner 6 is suspended in the open wellbore section 4. An annular space 7 is formed between the expandable liner 6 and the wellbore wall 5.

The liner 6 has a first or downhole end part 16 and a second or uphole end part 8. The second end part 8 extends into the casing 3. Throughout this specification, an upper end may indicate an uphole end, whereas lower end may be used to indicate the downhole end on any of the described features.

A drill string 10 extends from a drilling rig, or workover rig, at surface (not shown) into the wellbore 1 and passes through the interior space of liner 6. The drill string 10 is at its downhole end provided with a conical expander 12 adapted to radially expand the liner 6. The rig is adapted to pull the drill string 10 with the expander 12 connected thereto towards surface through the liner 6. Towards surface herein may imply in upward direction as well as partly horizontal direction. The drill string 10 is further provided with an on/off sub 11 which allows the drill string 10 to be disconnected from the expander 12 if required.

The diameter of the expander 12 is such that the expander 12 will expand the upper end 8 of the liner 6 forcedly against the inner surface of the casing 3 so that a tight connection is achieved between the upper end 8 of the liner 6 and the casing 3. The drill string 10 and the expander 12 have a common central bore 13 which provides fluid communication between a pumping facility at surface (not shown) and the open wellbore section 4. The central bore 13 is provided with a dart catcher 14 (or ball catcher) for receiving a dart (or a ball) that may be pumped through the central bore 13 of the drill string 10.

As shown in FIG. 1, the expander 12 is positioned below the liner 6 before expansion of the liner is started. The expander 12 is at its upper end provided with a centraliser 15 for centralising the expander 12 relative to the liner 6. The centraliser 15 extends into a second end part 16 of the liner 6. Said second end 16 is a downhole or lower end. The centralizer is connected to the liner 6 by a releasable connection (not shown), for example one or more shear pins. The releasable connection automatically disconnects when the drill string 10 pulls expander 12 upwards through the liner 6. Thus before expansion of the liner 6 commences, liner 6 is supported in the wellbore 1 by the drill string 10. Herein the weight of the liner 6 is transferred via the expander 12 to the drill string 10. Furthermore, the drill string 10 is provided with a release sub 18 arranged a short distance above the centraliser 15. The function of the release sub 18 will be explained hereinafter.

The upper end of the liner 6 is provided with a top anchor 20 comprising an anchor body 22 and a plurality of anchor members 24 mutually spaced along the circumference of anchor body 22. The top anchor 20 is releasably connected to the liner 6 by arms 26 extending from the anchor body 22 into the liner 6 and clamped to the inner surface of the liner 6.

FIG. 2 shows a detail of the top anchor 20, indicating one of the anchor members 24, the other anchor members being similar in design and functionality. The anchor member 24 has a serrated outer surface forming teeth 28, and a slanted inner surface 30 resting against a corresponding slanted surface 32 of a support element 34. The slanted surface 30 and the corresponding slanted surface 32 are complementary in shape. The anchor member 24 and the support element 34 are arranged in a chamber 36 of the anchor body 22, whereby both the anchor member 24 and the support element 34 are radially movable in chamber 36 between a retracted position and an extended position. The anchor member 24, when in the extended position, extends radially outward from chamber 36 and engages the inner surface of the liner 6. In the retracted position, the anchor member 24 is free from the inner surface of the liner 6. To move the anchor member 24 and the support element 34 between their respective retracted and extended positions, a hydraulic actuator 38 is provided in the chamber 36, the hydraulic actuator 38 being in fluid communication with the central bore 13 of the drill string 10 at a location above the dart catcher 14 so as to allow the hydraulic actuator 38 to be controlled by fluid pressure in the central bore of the drill string 10 when the central bore 13 is blocked by a dart (or ball) received in the catcher 14. The top anchor 20 is further provided with a release device (not shown) arranged to induce the support element 34 and the anchor member 24 to move to their respective retracted position when the release sub 18 of the drill string 10 is pulled against the release device of the top anchor 20.

Further, the anchor member 24 has some axial clearance in the chamber 36 so as to allow anchor member 24 to slide in axial direction a short distance along the slanted surface 32 of support element 34. As a result of such sliding movement along the slanted surface 32, the anchor member 24 when in the extended position firmly grips the inner surface of the casing 3 if the anchor body 22 is moved upwards a short distance, and the anchor member 24 releases the inner surface of the casing 3 if the anchor body 22 is moved downwards. In this manner it is achieved that the upper end part 8 of the liner 6 is allowed to move downwards due to axial shortening of the liner during radial expansion, while the top anchor 20 substantially prevents upward movement of upper end part 8 of the liner 6.

In a practical embodiment, a ramp angle $\alpha$ of the slanted surface 32 is in the range of about 5 to 30 degrees, for instance 8 to 20 degrees. An angle $\beta$, i.e. the top angle of teeth 28 on the anchor members 24 is in the range of about 60 to 120 degrees. Herein, a top surface of the teeth is substantially perpendicular to the axis of the drill string. A length or height L1 of the anchor member 24 is for instance in the range of about 0.5 to 3 times the diameter of the expandable casing 6. The axial clearance L2, i.e. a maximum stroke length of the anchor members, is for instance in the order of (diameter host casing 3−diameter expandable casing 6)/2/tan(alpha):

$$L2 \sim (\text{diameter casing } 3 - \text{diameter liner } 6)/2/\tan(\alpha).$$

The length of height L3 of the chamber 36 is in the order of the length L1 of the anchor members 24+the stroke L2 of the anchor members 24.

Reference is further made to FIGS. 3-9 showing, in longitudinal section, various embodiments of a foldable wall section 39 of the lower end part 16 of the liner 6. In each embodiment, reference numeral 40 indicates the central longitudinal axis of the liner 6.

In the first embodiment, shown in FIG. 3, an outer annular groove 45 is formed at the outer surface of the lower end part 16.

In the second embodiment, shown in FIG. 4, an outer annular groove 46 is formed at the outer surface and two inner annular grooves 47, 48 are formed at the inner surface of the lower end part 16. The inner grooves 47, 48 are symmetrically arranged relative the outer groove 46.

In the third embodiment, shown in FIG. 5, an inner annular groove 49 is formed at the inner surface and two outer annular grooves 50, 51 are formed at the outer surface of the lower end part 16, the outer grooves 50, 51 being symmetrically arranged relative the inner groove 49.

In the fourth embodiment, shown in FIGS. 6 and 7, the foldable wall section 39 includes an inner annular groove 52 at the inner surface and two outer annular grooves 53, 54 at the outer surface of the lower end part 16, the outer grooves 53, 54 being symmetrically arranged relative to the inner groove 52. The inner groove 52 tapers in radially outward direction. By virtue of the presence of the annular grooves 52, 53, 54, the lower end part 16 of the liner 6 is deformable from an unfolded mode (FIG. 6) to a folded mode (FIG. 7) by application of a selected compressive force to the lower end part 16. In the folded mode, an annular fold 55 is formed in the lower end part 16 of the liner. The annular fold 55 has an upper leg 55*a* extending between the outer groove 53 and the inner groove 52, and a lower leg 55*b* extending between the inner groove 52 and the outer groove 54. Hereinafter the compressive force that needs to be applied to the lower end part 16 to form the annular fold 55, is referred to as "folding force". It will be apparent that the magnitude of the folding force depends on the design characteristics of the lower end part 16, i.e. the material properties of the liner wall, the wall thickness, the depth and width of the annular grooves, and the axial spacing between the grooves. For example, the folding force decreases with decreasing bending stiffness of the wall of the liner 6 or with increasing depth of the grooves 52, 53, 54. Also, the folding force increases with increasing axial spacing between the grooves 52, 53, 54. It is preferred that these design characteristics are selected such that the folding force is of lower magnitude than the force required to pull the expander 12 through the liner 6 during radial expansion of the liner 6, for reason explained hereinafter.

The first, second and third embodiments of the foldable wall section described hereinbefore with reference to FIGS. 3-5, are deformable from an unfolded mode to a folded mode in a manner similar to deformation of the foldable wall section of the fourth embodiment.

In the fifth embodiment, shown in FIGS. 8 and 9, the foldable wall section 39 is formed by a section of reduced wall thickness 56 where the wall is recessed at both the inner surface and the outer surface. By virtue of the recessed wall section 56, the lower end part 16 of the liner 6 is deformable from an unfolded mode (FIG. 8) to a folded mode (FIG. 9) by application of a selected compressive force to the lower end part 16 of the liner 6, which compressive force is again referred to as "folding force". In the folded mode, a plurality of annular folds is formed in the lower end part 16 of the liner. The present example shows two annular folds 57, 58 in a concertina shape, however more annular folds can be formed in similar manner. The magnitude of the folding force depends on the design characteristics of the lower end part 16, i.e. the material properties of the liner wall, the wall thickness of the recessed section 56 of the liner 6, and the axial length of the recessed section 56. For example, the folding force decreases with decreasing bending stiffness of the recessed section 56 or with decreasing wall thickness of the recessed section 56. It is preferred that these design characteristics are selected such that the folding force is of lower magnitude than the force required to pull the expander 12 through the liner 6 during radial expansion of the liner 6, for reason explained hereinafter.

Referring further to FIGS. 10-12, the lower end part 16 of liner 6 is provided with bottom anchors 59, each bottom anchor 59 being adapted to engage the wellbore wall 5 as a result of radial expansion of the lower end part 16 so that the lower end part 16 becomes anchored to the wellbore wall 5. In FIG. 1, three such bottom anchors 59 are indicated. However any other suitable number of bottom anchors 59 can be applied.

Each bottom anchor 59 comprises an anchor arm 60 and a wedge member 62, both mounted on the outer surface of the lower end part 16 of liner 6 and vertically displaced from each other. The anchor arm 60 is provided with annular grooves 63*a*, 63*b*, 63*c* forming plastic hinges allowing radially outward bending of the anchor arm. Although three annular grooves are shown, any other number of grooves can be applied in accordance with circumstances. Furthermore, the anchor arm 60 has a fixed end 64 affixed to the outside of liner 6, for example by welding or other suitable means, and a free end 65 extending toward wedge member 62. The free end 65, also referred to as "tip", is not affixed to the outside of liner 6 so that all of anchor arm 60 except fixed end 64 is free to move relative to liner 6. The anchor arm 60 may be constructed such that its inner diameter is the same as or greater than the unexpanded outside diameter of liner 6.

Similarly, wedge member 62 includes a fixed end 66 affixed to liner 6, for example by welding or other suitable means. The free other end of the wedge member 62 extends toward the anchor arm 60 and defines a brace 68 having a length $L_B$. Brace 68 is not affixed to the outside of liner 6 and is free to move relative to the liner 6. At the free end, wedge member 62 includes a ramp 70 extending toward the anchor arm 60 and touching, or nearly touching, the free end 65 of the anchor arm 60. The ramp 70 may be constructed with any desired surface angle and may be integral with or a separate piece from brace 68. The thickness of each wedge member 62 and anchor arm 60 is a matter of design, but is limited by the maximum allowable diameter of the system prior to expansion.

Anchor arm 60 and wedge member 62 can each have either an annular and/or a segmented construction. In a segmented construction, anchor arm 60 and/or wedge member 62 may comprise longitudinal strips, rods, or plates. As shown in FIG. 12, the anchor arm 60 and the wedge member 62 each comprise for instance eight strips 72, 74 respectively. The strips 72, 74 extend around the outer circumference of the liner 6. Optionally, the strips of the anchor arm 60 and/or the wedge member 62 include a segmented section, comprising strips or fingers 76 of smaller width than the strips. The anchor arm and the wedge member may include any number of strips 72, 74 and/or corresponding fingers 76 suitable in relation to the size of the liner 6.

Hereinafter normal operation of the system of FIG. 1 is explained whereby it is assumed that the lower end part 16 of the liner 6 is provided with the fourth embodiment of the foldable wall section (shown in FIGS. 6 and 7). Normal operation of the system, if provided with the other embodiments of the foldable wall section, is similar to normal operation of the system provided with the fourth embodiment. Further it is assumed that the open wellbore section 4 has already been drilled using a conventional drill string (not shown) which has been removed from the wellbore 1.

During normal operation, the assembly formed by the drill string 10, the expander 12, the centraliser 15, the expandable liner 6 and the top anchor 20 is lowered on the drill string 10 into the wellbore until the major part of the liner 6 is positioned in the open wellbore section 4 whereby only the upper end part 8 of the liner extends into the casing 3 (as shown in FIG. 1). The anchor members 24 of the top anchor 20 are in the retracted position during the lowering operation.

Referring further to FIG. 13, in a next step a slurry of cement is pumped from surface via the central bore 13 of the drill string 10 and the expander 12 into the open wellbore section 4. The cement slurry flows into the annular space 7 between the liner 6 and the wellbore wall 5 so as to form a body of cement 80 which is still in fluidic state. Thereafter a dart (not shown) is pumped using a stream of fluid, for example drilling fluid, through the central bore 13. When the dart enters the dart catcher 14, any further passage of fluid through the central bore 13 is blocked. As a result a pressure pulse is generated in the stream of fluid, which induces the actuators 38 to move the respective anchor members 24 to their extended position so that the anchor members 24 become engaged with the inner surface of the liner 6. The fluid pressure in the stream of fluid is then temporarily further increased to release the dart from the dart catcher 14 and thereby to restore the hydraulic connection between the open hole section 4 and the drilling rig at surface.

Referring further to FIG. 14, in a next step an upward pulling force is applied to the drill string 10 so that the assembly formed by the drill string 10, the expander 12, the centraliser 15, the expandable liner 6 and the top anchor 20 moves upwards an incremental distance. While the anchor body 22 moves upwards, the anchor members 24 have a tendency of remaining stationary due to friction between the anchor members 24 and the inner surface of the liner 6. As a result the anchor members 24 slide downwards relative to the support elements 34 whereby the anchor members 24 are forced radially outward into a gripping engagement with the inner surface of the casing 3. In this manner the top anchor 20 is activated and prevents any further upward movement of the liner 6 in the wellbore 1.

The upward pulling force applied from surface to the drill string 10 is then further increased until the compressive force exerted by the expander 12 to the lower end part 16 of the liner 6 reaches the magnitude of the folding force. Upon reaching the folding force, the foldable wall section of the lower end part 16 moves from the unfolded mode to the folded mode whereby the annular fold 55 is formed. The fold 55 extends radially outward from the remainder of the liner 6 and into the annular space 7. The fold 55 thus formed may locally contact the wellbore wall 5, however that is a not yet a requirement.

After the fold 55 has been formed, the upward pulling force applied to the drill string 10 is further increased until the upward force exerted to the expander 12 reaches the magnitude of the expansion force which is the force required to pull the expander 12 through the liner 6 during expansion of the liner 6. The expander 12 is thereby pulled into the lower end part 16 of the liner 6 and starts expanding the liner 6. The centraliser 15 becomes automatically disconnected from the liner 6 by virtue of the upward movement of the expander 12. If, for example, shear pins are used to connect the centraliser 15 to the liner 6, such shear pins shear-off upon upward movement of the expander.

As a result of radial expansion of the lower end part 16 of the liner 6, the fold 55 is radially expanded and is thereby compressed against the wellbore wall 5. In this manner the expanded annular fold 55 forms a sealing member that seals an upper portion 90 of the annular space 7 above the fold 55 from a lower portion 92 of the annular space below the fold 55. Since the fold 55 is formed at the lower end part 16 of the liner, which is near the wellbore bottom, the lower portion 92 of the annular space is of minor volume relative to the upper portion 90. By virtue of the fold 55 forming a sealing member, no substantial flow-back of fluidic cement 80 from the upper portion 90 of the annular space 7 into the lower portion 92 occurs during further expansion of the liner 6.

The expansion process then proceeds by pulling the expander 12 further upwards through the liner 6. The liner 6 is subject to axial shortening due to the expansion process. Therefore, as the expander 12 passes through the lower end part 16 of the liner, at each bottom anchor 59 the axial distance between the fixed end 64 of the anchor arm 60 and the fixed end 66 of the wedge member 62 decreases. As a result, the free end 65 of the anchor arm slides onto the ramp 70 and toward the borehole wall 5, thereby overlapping the ramp 70 and extending radially outward from the liner 6. Preferably the length of the anchor arm 60 is selected such that the free end 65 thereof engages the borehole wall 5 by the time that the expander 12 passes the ramp 70.

The expander 12 subsequently progresses beyond the ramp 70, and the liner 6 continues to expand and shorten at the position of the expander. Due to the shortening, fixed end 64 of wedge member 62 moves toward anchor arm 60, and as a result ramp 70 is pushed against anchor arm 60. If the radial force on the free end of anchor arm 60, which is induced by shortening of the liner 6 due to expansion thereof, is greater than the local resistance or strength of the formation, the tip of the anchor arm 60 at the free end thereof will penetrate further into the formation.

However, if said radial force is smaller than or equal to the local resistance or strength of the formation, the tip 65 of the anchor arm 60 will be unable to penetrate further into the formation. In that case, anchor arm 60 will be held in place by the formation and ramp 70 will in turn be held in place by anchor arm 60. With the brace 68 of wedge member 62 unable to slide further along the outside of liner 6, no further shortening can occur. The final distance between fixed end 66 of wedge member 62 and fixed end 64 of anchor arm 60 is reached once the expansion device has moved past the fixed end 66 of the wedge member 62. If the free end of the wedge member 62, which comprises the ramp 70, is held in place by the anchor arm, the maximum load that is applied to the wall of the liner 6 is about equal to the so-called fixed-fixed load. The fixed-fixed load is the local load that is applied to the liner wall when the expander 12 moves between two points at which the liner is fixed, such that the liner cannot shorten between the two points. As the fixed-fixed load can be determined beforehand, for instance during lab tests, the anchor arm 60 of the invention can be designed such that the radial force exerted on the formation does not exceed the maximum allowable radial load applied to the wall of the liner 6. Thus, the anchor arm of the present invention ensures that the liner wall can be sufficiently strong to withstand the maximum radial force during expansion, so that the wall will remain substantially circular (in cross-section) when the anchor arm engages the formation. This embodiment allows the liner 6 to be designed so as to avoid collapse, even in the event that the formation is too hard to receive the anchor arm 60, as the maximum load on the liner wall will not exceed the fixed-fixed load, which can be calculated or at least determined empirically. In this manner it is prevented that collapse, rupture, or similar damage to the liner wall occurs during the expansion process. As indicated above, if the expandable liner 6 were damaged, the entire downhole section could be rendered useless and would then have to be removed, at considerable costs. The expandable liner arrangement of the present invention thus greatly improves reliability in this respect.

The radial load during expansion on the liner 6 and on the formation depends for instance on one or more of the surface angle of the ramp 70, the friction between the wedge member 62 and the liner 6, the friction between the wedge member 62 and the anchor arm 60, the formation hardness, the distance between the liner wall and the formation during expansion, etc. The surface angle of the ramp is preferably designed such that a maximum radial force is applied, whereas at the same time the radial load remains within the radial collapse load of the liner.

As the radial and axial loads on the wall of the tubular element are limited, the present embodiment is suitable for relatively hard formations, such as those, for example, having a strength or hardness of for instance 3000 psi (20 MPa) to 4000 psi (28 MPa) or more. In addition, the radial load on the wall can be limited by limiting the overlap between the anchor arm and the wedge member, and/or by limiting the contact area between the anchor arm and the formation. In a practical embodiment, the surface angle of the ramp 70 is in the range of 30 to 60 degrees, for instance about 45 degrees.

In this manner the lower end part 16 of the liner 6 is firmly anchored to the wellbore wall 5 after expansion of the lower end part 16. Therefore the position of the lower end part 16 in the wellbore 1 does not change anymore during further expansion of the liner, and thereby provides a reference point, for example during installation of a next tubular element in the wellbore at a later stage or during a workover operation in the wellbore. This is advantageous since it obviates the need to determine the position of the lower end part 16 of the liner 6 at such later stage.

With the lower end part 16 of the liner firmly anchored to the wellbore wall 5, the expander 12 is further pulled upwards through the liner 6 so as to radially expand the remaining part of the liner. The upper end of the liner with the top anchor 20 connected thereto moves downwards due to axial shortening of the liner during the expansion process, whereby the anchor members 24 automatically release the inner surface of the casing 3 as explained hereinbefore. As the expander 12 passes through the upper end part 8 of the liner 6, said upper end part 8 is thereby clad against the casing 3 so as to form a strong and fluid tight connection between the expanded liner 6 and the casing 3. Optionally the outer surface of the upper end part 8 of the liner can be provided with one or more elastomeric seals to enhance the fluid tightness between the expanded upper end 8 and the casing 3.

At this stage the release sub 18 of the drill string 10 is pulled against the release device of the top anchor 20 so that the anchor members 24 thereby move to their retracted positions. By pulling the drill string 10 further upwards, the expander 12 pushes the arms 26 of the top anchor 20 out of the upper end part 8 of the liner 6. The drill string 10 with the expander 12, the centraliser 15 and the top anchor 20 attached thereto, is then retrieved to surface.

The body of cement 80 in the annular space 7 is allowed to harden after the expansion process is finalised. By virtue of the fold 55 which forms an annular sealing member, no substantial volume of hardened cement is present in the lower portion 92 of the annular space 7 after the expansion process is completed. Therefore only a minor cement plug, or no cement plug at all, needs to be drilled out if the wellbore 1 is to be drilled deeper. If a next expandable liner is to be installed in the wellbore, the already expanded liner takes the role of the casing. It is then preferred that an expander of slightly smaller diameter or a collapsible expander is used to expand such next liner to allow the expander to be lowered with some clearance through the already expanded liner.

The alternative embodiment of the system according to the invention, as shown in FIG. 15 is similar to the embodiment described hereinbefore with reference to FIGS. 1-14, except that the drill string 10 extends below the expander 12 and is there provided with a drilling assembly including a collapsible underreamer 94 and a steerable drilling tool 96 having a pilot drill bit 98. The underreamer 94, when in collapsed mode, and the steerable drilling tool 96 are of smaller diameter than the inner diameter of the expanded liner 6 so as to allow the underreamer 94 and the steerable drilling tool 96 to be retrieved to surface through the expanded liner 6.

Normal operation of the alternative embodiment shown in FIG. 15 is similar to normal operation of the embodiment described hereinbefore with reference to FIGS. 1-14, except that the open wellbore section 4 is not drilled using a separate drill string before lowering the liner into the wellbore 1. Instead, the open wellbore section is drilled using the underreamer 94 and the steerable drilling tool 96. After drilling with the underreamer 94 and the steerable drilling tool 96, the liner 6 is expanded in the manner described hereinbefore. It is an advantage of the alternative embodiment that the liner 6 is drilled to target depth and subsequently expanded without requiring an extra round trip. In order to provide adequate flow area for drilling fluid during drilling of wellbore section 4, it is preferred that the expander 12 is collapsible to a relatively small diameter.

In exemplary embodiments, the foldable wall section of the wall of the expandable tubular element may have a thickness of about 50% or less than the thickness remainder of the tubular element, for instance about 40% or less. The length of the foldable wall section is for instance in the range of about 50 to 500 mm, for instance in the range of about 75 to 150 mm. The expansion ratio of the tubular element, being the ratio of the pipe diameter of the expanded pipe relative to the pipe diameter of the pipe before expansion, may be in the range of 5 to 25%, for instance about 10 to 20%. The expansion ratio of the foldable wall section, being the ratio of the outer diameter of the foldable wall section after expansion relative to the outer diameter of the foldable wall section before expansion, may be in the range of 30% to 60%, for instance about 40 to 55%. After expansion, the folded section may seal against an enclosed wall (such as the wellbore wall), providing a fluid tightness of more than 50 bar, or for instance more than about 150 bar. Herein, fluid tightness provides zonal isolation between annular areas above and below the folded section respectively. The folding force required to expand and fold the foldable section is for instance in the range of about 250 to 1000 kN, for instance 400 to 700 kN. Tubular elements may be substantially made of solid steel.

A number of tests have been performed on pipe samples having a foldable wall section to test the forming of annular folds under compressive loading and subsequent radial expansion of the folds thus formed, as described hereinafter.

Test 1

The test samples have a foldable wall section in accordance with the fifth embodiment described hereinbefore (FIGS. 8 and 9). Furthermore, the test samples have the following characteristics:

manufacturer: V&M
material: S355J2H
outer diameter: 139.7 mm
wall thickness: 10 mm
yield strength: 388 MPa tensile strength: 549 MPa
production method: seamless
heat treatment: normalized The pipe sample has a section with a reduced thickness of 3.5 mm, which section has a length of 100 mm. To ensure proper centralisation of the machining and a uniform wall thickness in the reduced section area, the wall has been recessed both at the inner surface and the outer surface. Furthermore a small annular groove is provided at the inner surface of the section of reduced wall thickness to initiate the folding action and lower the required compressive folding force. The pipe samples were internally lubricated with Malleus STC1 lubricant prior to expansion. The expander used for expanding the samples is a Sverker21 material with an outer diameter of 140.2 mm. The expansion ratio, being the ratio of the increase in pipe diameter to the diameter before expansion, with the expander is 17%.

A compressive load was applied by the expander to the sample to cause the foldable wall section to fold into a concertina shape. The test showed that the required force to initiate the folding is about 450 kN. The applied load caused iterative formation of wrinkles on the sample, evolving to a folded section. The folded section has a lower axial stiffness and collapse resistance than the remainder of the sample, leading to a significant drop of the axial load during the formation of each fold. The outer diameter of the fold thus formed was 170.4 mm. This corresponds to an equivalent expansion ratio of 37%. The load applied to the expander was then increased to pull the expander through the pipe sample to radially expand the sample. The outer diameter of the fold after being expanded was 185.1 mm which corresponds to an equivalent expansion ratio of about 50%. The tests showed that the average expansion load, i.e. the force required to move the expander through the sample, is about 520 kN with a peak load of 650 kN during expansion of the fold.

Test 2

The test samples have a foldable wall section in accordance with the fifth embodiment described hereinbefore (FIGS. 8 and 9). Furthermore, the test samples have the following characteristics:

manufacturer: V&M
material: S355J2H
outer diameter: 139.7 mm
wall thickness: 10 mm
yield strength: 388 MPa
tensile strength: 549 MPa
production method: seamless
heat treatment: normalized The pipe sample has a section with a reduced thickness of 3.5 mm, which section has a length of 100 mm. To ensure proper centralisation of the machining and a uniform wall thickness in the reduced section area, the wall has been recessed both at the inner surface and the outer surface. Furthermore a small annular groove is provided at the inner surface of the section of reduced wall thickness to initiate the folding action and lower the required compressive folding force. The pipe samples were internally lubricated with Malleus STC1 lubricant prior to expansion. The expander used for expanding the samples is a Sverker21 material with an outer diameter of 140.2 mm. The expansion ratio, being the ratio of the increase in pipe diameter to the diameter before expansion, with the expander is 17%. The sample has been placed and expanded inside a S355J2H steel pipe with an internal diameter of 174.7 mm and 9.5 mm wall thickness.

A compressive load was applied by the expander to the sample to cause the foldable wall section to fold into a concertina shape. The test showed that the required force to initiate the folding is about 450 kN. The applied load caused iterative formation of wrinkles on the sample, evolving to a folded section. The folded section has a lower axial stiffness and collapse resistance than the remainder of the sample, leading to a significant drop of the axial load during the formation of each fold. The load applied to the expander was then increased to pull the expander through the pipe sample to radially expand the sample. The outer diameter of the fold after being expanded was in contact with the internal diameter of the outer pipe which corresponds to an equivalent expansion ratio of about 41%. The tests showed that the average expansion load, i.e. the force required to move the expander through the sample, is about 520 kN with a peak load of 850 kN during expansion of the fold. The annular space between the inner and outer pipe has been subjected to water pressure. The pressure test revealed a pressure tightness of about 200 bar.

The present invention is not limited to the above described embodiments thereof, wherein many modifications are conceivable within the scope of the appended claims. Features of respective embodiments may for instance be combined.

That which is claimed is:

1. A system for lining a wellbore, the system comprising:

an expandable tubular element for arrangement in the wellbore, the tubular element having a first end part and a second end part, the second end part being adapted to extend within a casing located in the wellbore, wherein the tubular element is provided with sealing means for sealing an annular space between the tubular element and a wall surrounding the tubular element, said sealing means including a foldable wall section of the tubular element, the foldable wall section having a reduced bending stiffness relative to a remainder wall section of the tubular element and being deformable from an unfolded mode to a folded mode by application of a compressive folding force to the tubular element, wherein the foldable wall section when in the folded mode comprises at least one annular fold extending radially outward into said annular space thereby forming a seal with the wall surrounding the tubular element;

an expander arranged to radially expand the tubular element by movement of the expander through the tubular element in a direction from the first end part to the second end part, said direction defining an expansion direction; and an anchor arranged to anchor said second end part to the casing, wherein the anchor substantially prevents movement of said second end part in the expansion direction and allows movement of said second end part in the direction opposite to the expansion direction, and wherein the anchor provides the necessary reaction force to counter the expansion forces exerted to the tubular element by the expander.

2. The system of claim 1, wherein said wall section of reduced bending stiffness comprises a wall section of reduced thickness relative to said remainder wall section or one or more annular grooves formed in the tubular element.

3. The system of claim 2, wherein the wall section of reduced thickness in the folded mode thereof a plurality of folds in a concertina shape.

4. The system of claim 1, wherein said wall section of reduced bending stiffness comprises one or more annular grooves formed in the tubular element.

5. The system of claim 1, wherein an expansion force needs to be applied to the expander in order to move the expander through the tubular element during radial expansion of the tubular element, and wherein the reduced bending stiffness of the foldable wall section is selected such that the magnitude of said folding force is lower than the magnitude of the expansion force.

6. The system of claim 1, wherein said anchor is a top anchor, and wherein said first end part of the tubular element is provided with a bottom anchor adapted to anchor said first end part to the wall of the wellbore as a result of radial expansion of said first end part by the expander.

* * * * *